US006736079B1

(12) United States Patent
Waterschoot et al.

(10) Patent No.: US 6,736,079 B1
(45) Date of Patent: May 18, 2004

(54) DEVICE AND METHOD FOR ADJUSTING THE HOOK HEIGHT AND FEEDING OF CURTAIN HOOKS

(75) Inventors: Petrus Cornelius Maria Waterschoot, Waalre (NL); Petrus Johannes Maria Goudsmits, Waalre (NL)

(73) Assignee: Wybenga Machines B.V. (NL)

( * ) Notice: Subject to any disclaimer, the term of this patent is extended or adjusted under 35 U.S.C. 154(b) by 0 days.

(21) Appl. No.: 10/111,199

(22) PCT Filed: Oct. 20, 2000

(86) PCT No.: PCT/NL00/00758

§ 371 (c)(1),
(2), (4) Date: Aug. 23, 2002

(87) PCT Pub. No.: WO01/31106

PCT Pub. Date: May 3, 2001

(30) Foreign Application Priority Data

Oct. 21, 1999 (NL) ..... 1013362

(51) Int. Cl.[7] ..... D05B 21/00; D05B 3/22
(52) U.S. Cl. ..... 112/475.08; 112/470.14
(58) Field of Search ..... 112/475.07, 475.08, 112/475.14, 104, 113, 115; 74/813 R, 816, 25

(56) References Cited

U.S. PATENT DOCUMENTS 4,498,404 A * 2/1985 Sadeh ..... 112/470.04
5,062,373 A * 11/1991 Kichizo et al. ..... 112/113
5,603,274 A * 2/1997 Conley et al. ..... 112/470.14

FOREIGN PATENT DOCUMENTS

| | | | |
|---|---|---|---|
| CH | 623 367 A | | 5/1981 |
| EP | 0 290 104 A | | 11/1988 |
| JP | 406621032 | * | 8/1994 |
| JP | 10 137476 A | | 5/1998 |
| JP | 10 225582 A | | 8/1998 |
| JP | 410201973 | * | 8/1998 |
| JP | 10 235 049 A | | 9/1998 |
| JP | 410263226 | * | 10/1998 |
| WO | 94 11558 A | | 5/1994 |

* cited by examiner

*Primary Examiner*—Ismael Izaguirre
(74) *Attorney, Agent, or Firm*—Webb Ziesenheim Logsdon Orkin & Hanson, P.C.

(57) ABSTRACT

The invention relates to a device for feeding curtain hooks, which each consists of a strip and a hook part connected thereto, to a sewing machine which can sew the strip of a supplied curtain hook to a curtain, comprising: a supply holder for the curtain hooks, displacing means for displacing one curtain hook at a time in a straight line to a desired position for sewing on the strip, and adjusting means for automatically adjusting the mutual position of strip and hook part connected thereto. The invention also relates to a method for feeding curtain hooks.

12 Claims, 2 Drawing Sheets

DEVICE AND METHOD FOR ADJUSTING THE HOOK HEIGHT AND FEEDING OF CURTAIN HOOKS

BACKGROUND OF THE INVENTION

1. Field of the Invention

The invention relates to a device for feeding curtain hooks, which each consist of a strip and a hook part connected thereto, to a sewing machine which can sew the strip of a supplied curtain hook to a curtain, comprising: a supply holder for the curtain hooks, displacing means for displacing one curtain hook at a time in a straight line to a desired position for sewing on the strip, and adjusting means for automatically adjusting the mutual position of strip and hook part connected thereto. The invention also relates to a method for feeding curtain hooks, which each consist of a strip and a hook part connected thereto, to a sewing machine which can sew the strip of a supplied curtain hook to a curtain.

2. Description of the Prior Art

The automatic feed of curtain hooks to a sewing machine along a straight path of movement is known from among others EP 0 637 345. Adjustment of the hook height, i.e. the mutual adjustment of a curtain hook consisting of a strip and a hook part, during the infeed route is also known from this publication. The use of the described device is particularly advantageous because it results in a reduced work load during the sewing of curtain hooks into curtains. Drawbacks of the prior art are that the existing devices take up a relatively large amount of space and that they function less precisely, particularly the hook height adjustment not being fully controllable.

The object of the present invention is to provide an improved device and method for automatic height-adjustment and feed of curtain hooks, whereby the drawbacks of the prior art are obviated while the existing advantages are retained.

SUMMARY OF THE INVENTION

The invention provides for this purpose a device of the type stated in the preamble characterized in that the adjusting means transport a curtain hook in a circle segment-shaped path from a position close to the underside of the supply holder to the straight line in which the displacing means displace a curtain hook, and during the progression through this circle segment-shaped transport path the desired mutual position of hook part and strip is adjusted. The displacement of the curtain hooks by means of a circle segment-shaped path prior to displacement thereof in a straight line to the sewing machine has a number of advantages. There thus results a greater freedom of choice in respect of the placing of the supply holder for curtain hooks; this no longer has to be localized above the linear feed path to the sewing machine. Particularly in the usually full curtain workshops in which the curtains to be manufactured require much space, this results in a considerable improvement in the utilization of the available space. The linear feed to the sewing machine can also take a more compact form. These feed means, heretofore often protruding in inconvenient manner, can be given a more compact embodiment.

Another advantage of the device according to the invention is that the first part of the infeed route (circle segment-shaped path), including the hook height adjustment, is hereby separated from the second part of the infeed route (linear path). This implies that, while the displacing means for displacing curtain hooks along a straight line are in operation, a subsequent curtain hook can already pass through the circle segment-shaped transport path, wherein it is simultaneously height-adjusted. The first part of the transport, including the hook height adjustment, hereby need not form part of the critical path in the feed and adjustment of curtain hooks. The device according to the invention can hereby operate more rapidly so that productivity can increase. A further advantage of adjusting the hook height outside the linear transport path to the sewing machine is that this enables a more certain locking of the strip of the curtain hook, whereby the adjustment of the position of the hook part on the strip can also be more readily controlled.

In a preferred embodiment the supply holder consists of a vertical tube in which the curtain hooks are buffered stacked on top of one another. Such a buffering of hooks is already known and can also be applied in combination with the device according to the invention. This enables the interchange of already existing supply holders with the device according to the invention. The advantage of the invention is that the relatively bulky supply holders can be placed at a position which is optimal for a seamstress, so that a holder is not inconvenient during use of the device and filling or exchanging of a supply holder is also simple.

In another preferred embodiment of the device the circle segment-shaped path of the adjusting means ends in or close to the straight line in which the displacing means displace a curtain hook. The circle segment-shaped path and the linear transport paths thus connect onto each other and no additional transfer means are required.

In yet another preferred embodiment the adjusting means comprise: at least one rotatable disc, which disc is adapted to carry a curtain hook, and a stop co-acting with the disc for engaging on the hook part of the curtain hook during rotation of the rotatable disc. Such a disc can be provided with locking means for fixing the position of the strip of a curtain hook carried by the disc. In order to obtain the desired hook height adjustment, an extreme working position of the stop can be adjustable, for instance by means of an adjusting member adjustable in a plurality of positions. Such adjusting means are relatively simple to manufacture and reliable in use. When a transmission is arranged between the adjusting member and the stop with a transmission ratio from a displacement of the adjusting member to a displacement of the stop for adjusting the extreme working position which is less than 1, it is then possible to adjust the device with an increased accuracy. Dimensional tolerances occurring during manufacture of the device or as a result of wear can thus be reduced (for instance by means of regular repeated fine adjustment of the device). The transmission ratio enables a precise control of the stop, with the resulting consequence that the hook height adjustment can be extra-accurate.

The adjusting means individually as described above also form part of the device according to the invention.

The invention moreover provides a method of the type stated in the preamble, comprising the successive steps of: A feeding a curtain hook from a supply holder along a circle segment-shaped path, a desired mutual position of the strip and the hook part being adjusted during the progression through this circle segment-shaped path, and B further displacing the curtain hook with adjusted hook height to a sewing machine along a linear path connecting onto the circle segment-shaped path. In a preferred application of this method the desired mutual position of the strip and the hook part is determined prior to progressing through step A by adjusting the means for feeding curtain hooks along the circle segment-shaped path. The orientation of the curtain hook after progressing through step A is preferably also the same as the orientation in which the curtain hook is further displaced according to step B. The advantages of this method are already described above with reference to the device according to the invention and the preferred embodiments thereof.

BRIEF DESCRIPTION OF THE DRAWING

The present invention will be further elucidated with reference to the non-limitative embodiments shown in the following figures. Herein.

DETAILED DESCRIPTION OF THE PREFERRED EMBODIMENTS

Figure 1:
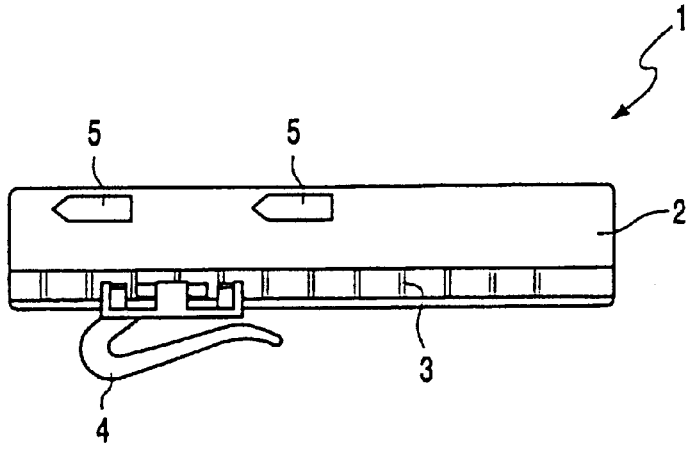
FIG. 1 shows a top view of a curtain hook with adjustable hook height.

FIG. 1 shows a curtain hook 1, generally manufactured from plastic, which comprises a strip 2 with a toothing 3 and a hook part 4. Hook part 4 engages on toothing 3 of strip 2 at an adjustable position. In strip 2 are arranged two recesses 5 for positioning of strip 2.

Figure 2:
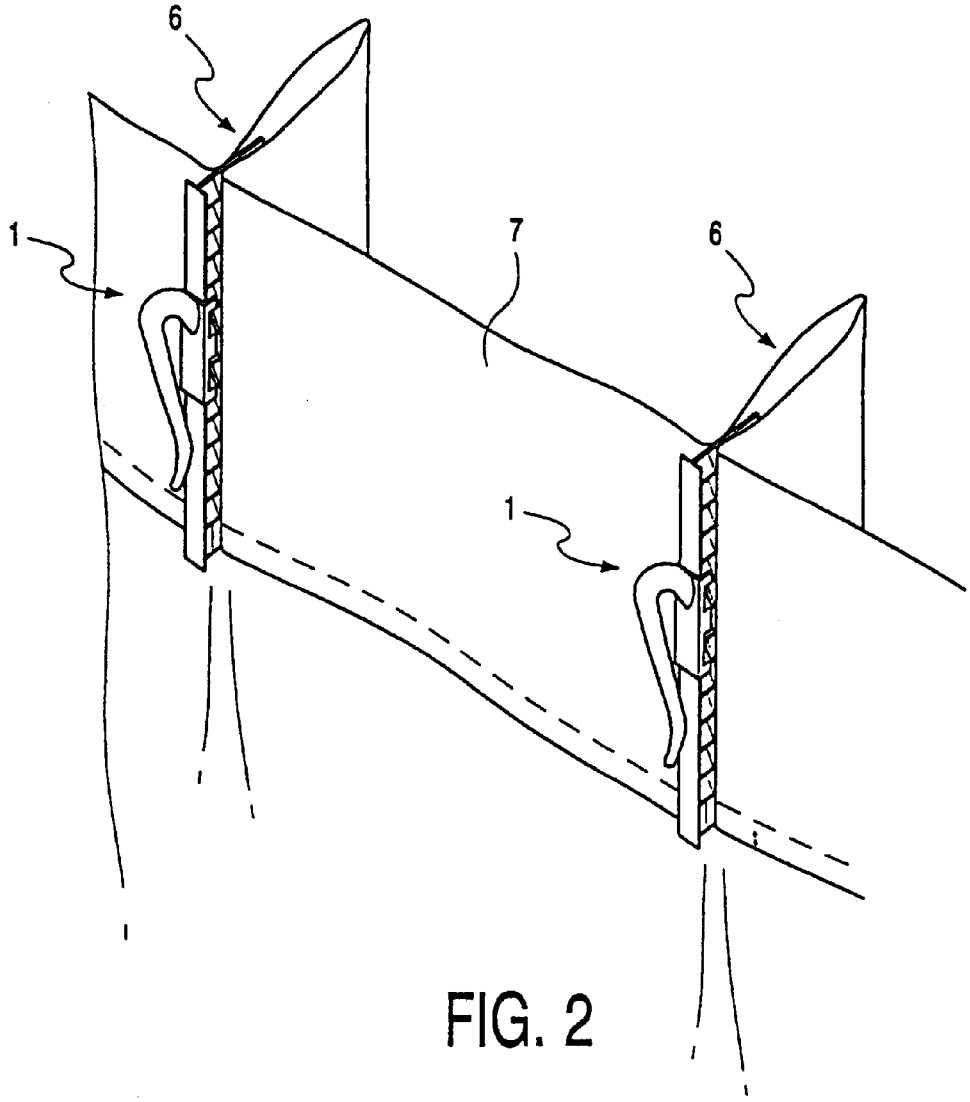
FIG. 2 is a perspective view of a part of a curtain with sewn-in curtain hooks.

FIG. 2 shows two curtain hooks 1 sewn into pleats 6 of a curtain 7. For simplified sewing-in thereof, the curtain hooks 1 are fed automatically to a sewing machine wherein the desired hook height is simultaneously adjusted by sliding hook part 4 relative to strip 2 until a desired mutual position is reached.

Figure 3:
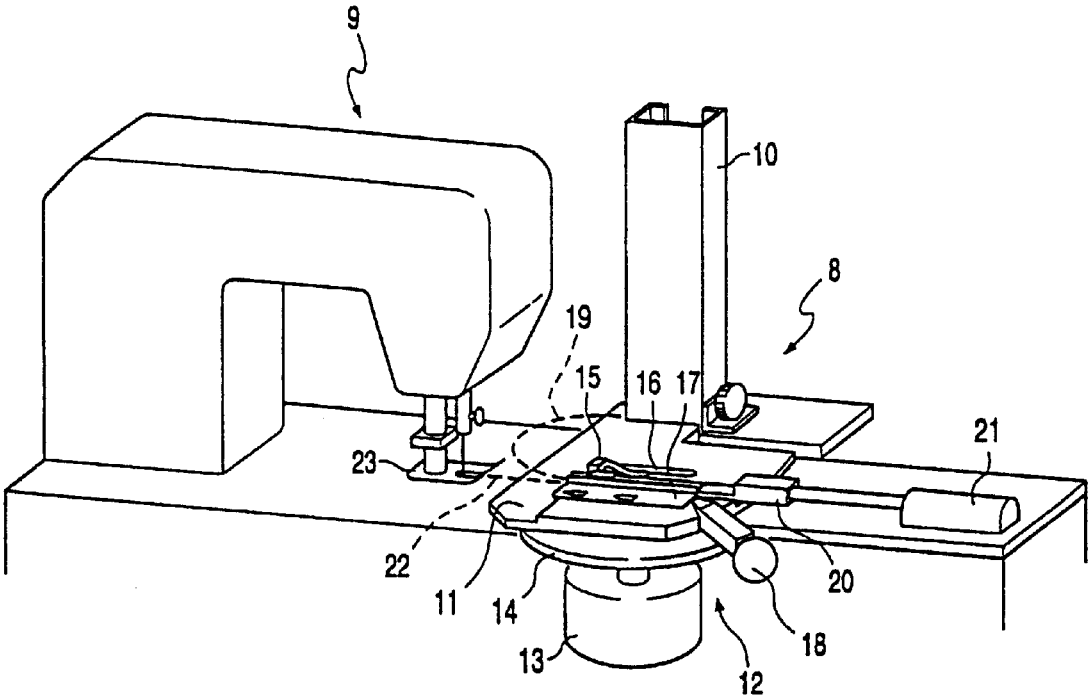
FIG. 3 is a perspective view of a schematic representation of the device according to the invention in combination with a sewing machine.

FIG. 3 shows a schematic view of a device 8 according to the invention in combination with a sewing machine 9. Curtain hooks 1, not shown in this figure, are buffered in a vertical supply holder 10, which supply holder 10 connects on the underside onto a rotatable disc 11 which forms part of adjusting means 12. Rotatable disc 11 is rotatable with an electric motor 13 situated on the underside of rotatable disc 11. Situated between electric motor 13 and the rotatable disc 11 is a second disc 14 which is rigidly connected to a stop 15 which protrudes through a slot 16 in rotatable disc 11. Stop 15 engages on the hook part 4 of a curtain hook 17 lying on rotatable disc 11. An extreme position (or hook-placement position) of the second disc 14, and thus also of stop 15, is determined by means of an adjusting member 18.

A curtain hook 17 fed from supply holder 10 is displaced to the shown position in a circle segment-shaped path 19, which is shown by means of a broken line, by rotating the rotatable disc 11. During the progression of rotatable disc 11 through circle segment-shaped path 19 the second disc 14 also co-rotates, at least until it is stopped by adjusting member 18. During displacement of curtain hook 17 the stop 15 engages on hook part 4 so that this hook part 4 is displaced relative to strip 2 of curtain hook 17. The end position of hook part 4 relative to strip 1 is determined by the extreme position of the stop 15, which corresponds with the position of the adjusting member 18 which limits the freedom of movement of second disc 14.

After the progression through the circle segment-shaped path 19, a rod 20, which is for instance provided with fingers (not shown), engages on curtain hook 17. Using a cylinder 21 the rod is moved along a linear path 22 (also shown by means of a broken line) to a position under a pressure foot 23 of sewing machine 9. The curtain hook can now be sewn onto a curtain 7.

It is noted here that the return movement of rod 20 can already begin once the position of curtain hook 17 is fixed by pressure foot 23.

Figure 4:
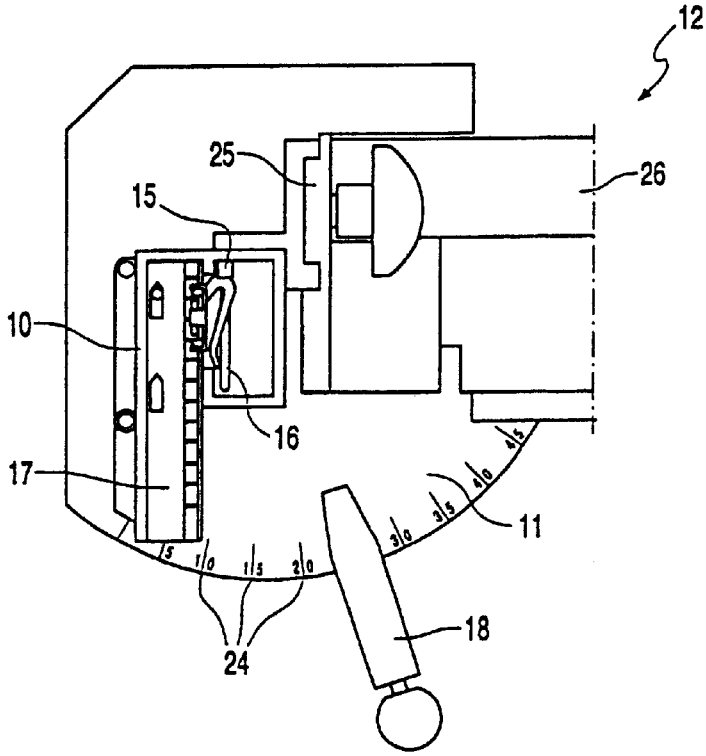
FIG. 4 shows a top view of a variant of the adjusting means which form part of the device shown in FIG. 3.

FIG. 4 shows the adjusting means 12 in top view. On the upper side of rotatable disc 11 is arranged a calibration 24 with which the placing of adjusting member 18 is related to the stated hook height adjustment. It is noted that in this figure the position of supply holder 10 differs from the situation shown in FIG. 3. In addition to the slot 16 in rotatable disc 11, the stop 15 protruding through this slot 16 is also clearly shown. This figure also shows rapid coupling means 25 for releasable connection of supply holder 10 to a support frame 26 such that the holder is situated a short distance above rotatable disc 11. Supply holder 10 is thus connected to the fixed components and does not co-rotate with discs 11, 14.

Although the invention is described with reference to only a few embodiments, it will be apparent to all that the invention is by no means limited to the described and shown embodiments. On the contrary, many more variations are possible for the skilled person within the scope of the invention.

What is claimed is:

1. Device for feeding curtain hooks, which each consists of a strip and a hook part connected thereto, to a sewing machine which can sew the strip of a supplied curtain hook to a curtain, comprising:

a supply holder for the curtain hooks, displacing means for displacing one curtain hook at a time in a straight line to a desired position for sewing on the strip, and adjusting means for automatically adjusting a mutual position of the strip and the hook part of the one curtain hook, wherein the adjusting means transport the one curtain hook in a circle segment-shaped path from a position close to an underside of the supply holder to the straight line in which the displacing means displace the one curtain hook, and during a progression through the circle segment-shaped path, a desired mutual position of the hook part and the strip is adjusted.

2. Device as claimed in claim 1, wherein the supply holder consists of a vertical tube in which the curtain hooks are buffered stacked on top of one another.

3. Device as claimed in claim 1, wherein the circle segment-shaped path of the adjusting means ends in or close to the straight line in which the displacing means displace a curtain hook.

4. Device as claimed in claim 1, wherein the adjusting means comprise: at least one rotatable disc, which disc is adapted to carry a curtain hook, and a stop co-acting with the disc for engaging on the hook part of the curtain hook during rotation of the rotatable disc.

5. Device as claimed in claim 4, wherein the rotatable disc is provided with locking means for fixing the position of the strip of a curtain hook carried by the disc.

6. Device as claimed in claim 4, wherein a hook-placement position of the stop is adjustable.

7. Device as claimed in claim 6, wherein the hook-placement position of the stop is adjustable with an adjusting member lockable in a plurality of positions.

8. Device as claimed in claim 7, wherein a transmission is arranged between the adjusting member and the stop with a transmission ratio from a displacement of the adjusting member to a displacement of the stop for adjusting the hook-placement position which is less than 1.

9. Method for feeding curtain hooks, which each consist of a strip and a hook part connected thereto, to a sewing machine which can sew the strip of a supplied curtain hook to a curtain, comprising the successive steps of:

A) feeding a curtain hook from a supply holder along a circle segment-shaped path, a desired mutual position of the strip and the hook part being adjusted during the progression through this circle segment-shaped path, and B) further displacing the curtain hook with the desired mutual position of the strip and the hook part to a sewing machine along a linear path connecting onto the circle segment-shaped path.

10. Method as claimed in claim 9, wherein the desired mutual position of the strip and the hook part is determined prior to progressing through step A by adjusting the means for feeding curtain hooks along the circle segment-shaped path.

11. Method as claimed in claim 9, wherein the orientation of the curtain hook after progressing through step A is the same as the orientation in which the curtain hook is further displaced according to step B.

12. In a device for feeding curtain hooks to a sewing machine for the purpose of sewing a strip of a supplied curtain hook to a curtain, the improvement comprising adjusting means, said adjusting means comprising:

at least one rotatable disc, said disc adapted to carry a curtain hook; and a stop coacting with the disc for engaging on the hook part of the curtain hook during rotation of the rotatable disc.

* * * * *